US007886474B2

(12) United States Patent
Werner

(10) Patent No.: US 7,886,474 B2
(45) Date of Patent: Feb. 15, 2011

(54) REST FOR CLEANING A RIFLE AND FOR SIGHTING A SCOPE, A STOCK, AND A BORE OF THE RIFLE

(76) Inventor: Theodore J. Werner, 193 W. Hills Rd., Huntington Station, NY (US) 11746

( * ) Notice: Subject to any disclaimer, the term of this patent is extended or adjusted under 35 U.S.C. 154(b) by 0 days.

(21) Appl. No.: 12/011,091

(22) Filed: Jan. 24, 2008

(65) Prior Publication Data

US 2009/0188146 A1 Jul. 30, 2009

(51) Int. Cl.
*F41C 27/00* (2006.01)

(52) U.S. Cl. ..... 42/94; 73/167

(58) Field of Classification Search ..... 42/94
See application file for complete search history.

(56) References Cited

U.S. PATENT DOCUMENTS

| | | | | |
|---|---|---|---|---|
| 4,841,839 | A * | 6/1989 | Stuart | 89/37.04 |
| 4,924,616 | A * | 5/1990 | Bell | 42/94 |
| 5,697,181 | A * | 12/1997 | Savant | 42/94 |
| 2006/0218840 | A1* | 10/2006 | Cauley | 42/94 |
| 2007/0074440 | A2* | 4/2007 | Cauley | 42/94 |
| 2008/0134555 | A1* | 6/2008 | Werner | 42/69.01 |
| 2008/0168697 | A1* | 7/2008 | Potterfield et al. | 42/94 |
| 2008/0209790 | A1* | 9/2008 | Bartle | 42/94 |

* cited by examiner

*Primary Examiner*—Troy Chambers
*Assistant Examiner*—Samir Abdosh
(74) *Attorney, Agent, or Firm*—Charles E. Baxley

(57) ABSTRACT

A rest for cleaning a rifle and for sighting a scope, a stock, and a bore of the rifle. The rest includes a base, a vise assembly, a fore-end support assembly, and an elevator assembly. The vise assembly adjusts for different-length rifles and clamps the stock of the rifle therein. The fore-end support assembly adjusts for the different-length rifles and supports the fore-end of the rifle thereon. The elevator assembly adjusts for the different-length rifles and supports the barrel of the rifle therein. The rest further includes a lapping tool, alignment tools, a stock alignment tool, a bore sighting tool, a centering tool, and a set of diopters. The lapping tool insures smoothness and proper interior profile of the mounting rings for a scope. The alignment tools insures that the scope fits properly without any binding or protrusions. The stock alignment tool lines up the stock of the gun so the gun is leveled. The bore sighting calibrates the scope. The centering tool cradles, centers, and supports the gun. A respective diopter is attached to an objective end of the scope to increase depth of field when a target is so close that the scope does not focus clearly.

3 Claims, 13 Drawing Sheets

REST FOR CLEANING A RIFLE AND FOR SIGHTING A SCOPE, A STOCK, AND A BORE OF THE RIFLE

1. BACKGROUND OF THE INVENTION

A. Field of the Invention

The embodiments of the present invention relate to a rest for a rifle, and more particularly, the embodiments of the present invention relate to a rest for cleaning a rifle and for sighting a scope, a stock, and a bore of the rifle.

B. Description of the Prior Art

Various forms of adjustable rifle rests have been heretofore provided to enable rifle sights to be properly adjusted and also to enable close checking of the accuracy of the rifle.

Whenever hunters, marksmen, or users of firearms use a rifle, the sights must be aligned relative to the rifle to assure the accuracy of the rifle. Preferably, the sights are adjusted independent of the shooter. Later detected inaccuracies can then be directed to correcting deficiencies in the shooter's form or technique, or the rifle can be compensated for the shooter in a known manner and not by mere guess.

The immobilization of rifles by way of portable devices is conventionally performed by way of gun mounts, bipods, tripods, or trestles, on which loads, such as bags of sand, rocks, etc can be disposed in order to improve the stability of the assembly, of which, however, the stability is random, since the configuration of these support systems does not permit accommodation of large additional loads. Nevertheless, the efficiency of an immobilizing device continues to be proportional to its weight as well as to its capacity for clamping effectively the rifle it receives.

In fact, at the beginning of each shot, the rifle is subjected to stresses taking the form of violent displacements, and the barrel withstands complex vibratory movements of which the amplitude and frequency have a determining influence on the distribution of the impacts on the target. It is thus obvious that in order to follow an identical trajectory, all the projectiles must clear the mouth of the barrel of the rifle at the moment when the mouth of the barrel of the rifle occupies a single position in space. For this purpose, a device that is as stable as possible must confer on the rifle a maximum level of immobility between and during each shot in order for the corrections made on the rifle, and particularly on its sighting units, to take place from a known constant reference position.

Many devices have been developed for holding a rifle in position during firing of the rifle and absorbing the recoil forces of the rifle. These devices can be useful in a variety of circumstances, for example, they can be used to adjust the gun sights or to test the mechanical integrity and accuracy of the rifle itself.

Most sportsmen, in fact 98% of them, improperly mount their telescopic sights. If it is tilted to the left, the gun will shoot low and to the left. If it is tilted to the right, the gun will shoot low and to the right. Therefore, proper leveling of the scope to the gun is critical.

Scopes do not function well if the exterior of the housing is subjected to stress because of deformities on the insides of the mounts or misaligned mounts.

Numerous innovations for rifle shooting and related devices have been provided in the prior art that will be described below, which are in chronological order to show advancement in the art, and which are incorporated herein by reference thereto. Even though these innovations may be suitable for the specific individual purposes to which they address, they each differ in structure, and/or operation, and/or purpose from the embodiments of the present invention in that they do not teach a rest for cleaning a rifle and for sighting a scope, a stock, and a bore of the rifle.

(1) U.S. Pat. No. 3,668,871 to Berndt et al.

U.S. Pat. No. 3,668,871 issued to Berndt et al. on Jun. 13, 1972 in class 60 and subclass 54.5 R teaches an hydraulic remote control apparatus for use in operating short-stroke valves located in the piston of an adjustment cylinder. The apparatus includes a pair of remotely located hydraulic chambers interconnected by way of a fluid-carrying conduit. A first hydraulic chamber is provided with a diaphragm and disk arrangement spanning the chamber to form fluid-tight operating and control compartments therein. A second hydraulic chamber has a smaller cross-section than the first chamber and is provided with a rolling elastomeric diaphragm, so that the volume of the second hydraulic chamber can be reduced by displacement of the plunger in a manner sufficient to deflect the rolling diaphragm.

(2) U.S. Pat. No. 4,012,860 to Auger.

U.S. Pat. No. 4,012,860 issued to Auger on Mar. 22, 1977 in class 42 and subclass 94 teaches a lower base and an elongated generally horizontal support member oscillatably supported from the base for angular displacement about a generally horizontal axis. The support member extends in a direction transverse to the axis of oscillation thereof and includes structure spaced above its axis of oscillation for removably stationarily supporting a rifle therefrom, with the rifle extending longitudinally of the support member. Adjustment structure is operatively connected between the base and the support member for infinite angular adjustment of the support member relative to the base throughout at least a limited sector of adjustment. In addition, an electric motor-driven structure is also provided for removable support from a rifle supported from the support member, and includes features for operative association with the trigger of the associated rifle, whereby the trigger may be gradually actuated without causing vibration of the rifle.

(3) U.S. Pat. No. 4,196,653 to Jackson.

U.S. Pat. No. 4,196,653 issued to Jackson on Apr. 8, 1980 in class 89 and subclass 136 teaches an auxiliary firing mechanism used to actuate a tripper for a gun trigger, including a remote actuator connected to the tripper by an elongated connector, such as a cable, that is moved by the cooperable action of a control member and a rotatably and axially movable actuator member of the actuator. Camming surfaces of the control member and the actuator member of the actuator move the control member from a first position to a second position against a spring bias thereof in order to actuate the tripper and thereby trip the gun trigger whereupon the camming surface of the actuator member moves out of engagement with the camming surface of the control member in order to allow the control member to be moved back to the first position by its spring bias. Axial and rotational movement of the actuator member then again engages the camming surfaces of the control and actuator members in preparation for another actuation of the tripper. A manually movable lever, preferably having a foot pedal, rotates the actuator member to provide the tripper actuation.

(4) U.S. Pat. No. 4,409,826 to Wenger.

U.S. Pat. No. 4,409,826 issued to Wenger on Oct. 18, 1983 in class 73 and subclass 167 teaches a test-firing apparatus, including a weapon-holder accommodating a rifle or handgun and a, preferably, freely mobile mounting for the holder in relation to a stationary base. A projecting support apparatus connected to the weapon allows the recoil-pulse to be absorbed in conjunction with the freely mobile mounting by the body of an operator as in practical shooting. The only purpose of the mounting, preferably in the form of a linear-precision guide including cross rollers, is to position the barrel-axis directionally, and the mounting is therefore subjected to little stress. Resilient and/or damping absorption of the recoil-pulse may also be provided. The barrel-axis is arranged in parallel with the movement-axis of the mounting, so that the point of impact of the bullet upon the target cannot be affected by the recoil-stroke. This parallelism may be adjusted by optical apparatus, preferably by way of a reference-weapon fitted to the weapon-holder. The barrel-axis of the reference-weapon is fixed parallel with the movement-axis by way of appropriate indexing elements. This indirect alignment is achieved by comparing the shot-patterns of the two weapons.

(5) U.S. Pat. No. 5,070,636 to Mueller.

U.S. Pat. No. 5,070,636 issued to Mueller on Dec. 10, 1991 in class 42 and subclass 94 teaches a weapon sighting assembly, including a longitudinally extending frame rotatively secured under tension about a shock plate coupling the assembly to a grounded support. A resiliently supported barrel rest is adjustably mounted along the longitudinal frame. A weapon-receiving cradle includes a compressive elastomeric pad and surfaces conforming to the aft end of the weapon and the marksperson's hand and/or shoulder. Cant adjustment apparatus is provided at the shock plate, windage adjustment apparatus couples to the longitudinal frame, and a resilient strap can be used to further couple a weapon to the assembly.

(6) U.S. Pat. No. 5,272,955 to Bond et al.

U.S. Pat. No. 5,272,955 issued to Bond et al. on Dec. 28, 1993 in class 89 and subclass 37.04 teaches a portable apparatus attachable to a wheelchair for movably supporting a gun thereon, including a pneumatic/hydraulic fluid-operated control circuit for operably controlling the direction of the gun while sitting in the wheelchair. The apparatus includes a support adapted to attach to the wheelchair and support a gun, and further includes a control system including an hydraulic linear actuator and an hydraulic rotary actuator operably connected to the support, an air tank operably connected through control valves and air/oil chambers to the actuators, and controls including a joystick that can be readily manipulated by the person in the wheelchair to move the control valves and thereby controllably actuate the actuators to aim the gun. A pair of oil interlock valves are operably connected to either side of each of the actuators to securely locate the gun in a given position once aimed.

(7) U.S. Pat. No. 5,375,804 to Levilly.

U.S. Pat. No. 5,375,804 issued to Levilly on Dec. 27, 1994 in class 248 and subclass 274 teaches a portable device for immobilizing individual firearms during adjustment firing. The device includes a seating intended to be attached to an existing support by attachment apparatus. The seating supports, so as to pivot about a first axis, a plate accommodating a rail that in turn is mounted so as to pivot on the plate about a second axis that is perpendicular to the first axis. The rail receives, in a sliding manner along its axis, at least two plates with adjustment slides. The slides are perpendicular to the axis of the rail and to the axis of pivoting of the rail. A U-shaped support is mounted in the slide of each plate and is provided with attachment apparatus intended to accommodate the weapon to be adjusted.

(8) U.S. Pat. No. 5,811,720 to Quinnell et al.

U.S. Pat. No. 5,811,720 issued to Quinnell et al. on Sep. 22, 1998 in class 89 and subclass 37.04 teaches a shooting rest for a rifle for absorbing the recoil produced when the rifle is fired. The rest includes a rifle-mounting structure, a base structure, and a swivel plate. The rifle is secured to the rifle-mounting structure having a mechanism for adjusting the elevation of the rifle barrel resting thereon. The rifle-mounting structure is slidably engaged to the base structure, so that the rifle-mounting structure may slide backwards in response to the recoil from firing the rifle. The recoil energy from the rifle is absorbed by several rubber balls when a first bracket mounted to the rifle mounting structure is forced backwards towards the rubber balls, which are held in position by a second bracket mounted to the base structure. The base structure may be mounted on a plate swivable around a vertical axis allowing the rifle to be aimed in different horizontal directions. The swivel plate can be adjustably secured to the edge of a shooting table, so that the shooting rest may be used at any rifle range or on any relatively flat surface without permanently attaching it to the surface.

It is apparent that numerous innovations for rifle shooting and related devices have been provided in the prior art that are adapted to be used. Furthermore, even though these innovations may be suitable for the specific individual purposes to which they address, they would not be suitable for the purposes of the embodiments of the present invention as heretofore described, namely, a rest for cleaning a rifle and for sighting a scope, a stock, and a bore of the rifle.

2. SUMMARY OF THE INVENTION

Thus, an object of the embodiments of the present invention is to provide a rest for cleaning a rifle and for sighting a scope, a stock, and a bore of the rifle, which avoids the disadvantages of the prior art.

Briefly stated, another object of the embodiments of the present invention is to provide a rest for cleaning a rifle and for sighting a scope, a stock, and a-bore of the rifle. The rest includes a base, a vise assembly, a fore-end support assembly, and an elevator assembly. The vise assembly adjusts for different-length rifles and clamps the stock of the rifle therein. The fore-end support assembly adjusts for the different-length rifles and supports the fore-end of the rifle thereon. The elevator assembly adjusts for the different-length rifles and supports the barrel of the rifle therein. The rest further includes a lapping tool, alignment tools, a stock alignment tool, a bore sighting tool, a centering tool, and a set of diopters. The lapping tool insures smoothness and proper interior profile of the mounting rings for a scope. The alignment tools insures that the scope fits properly without any binding or protrusions. The stock alignment tool lines up the stock of the gun so the gun is leveled. The bore sighting calibrates the scope. The centering tool cradles, centers, and supports the gun. A respective diopter is attached to an objective end of the scope to increase depth of field when a target is so close that the scope does not focus clearly.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
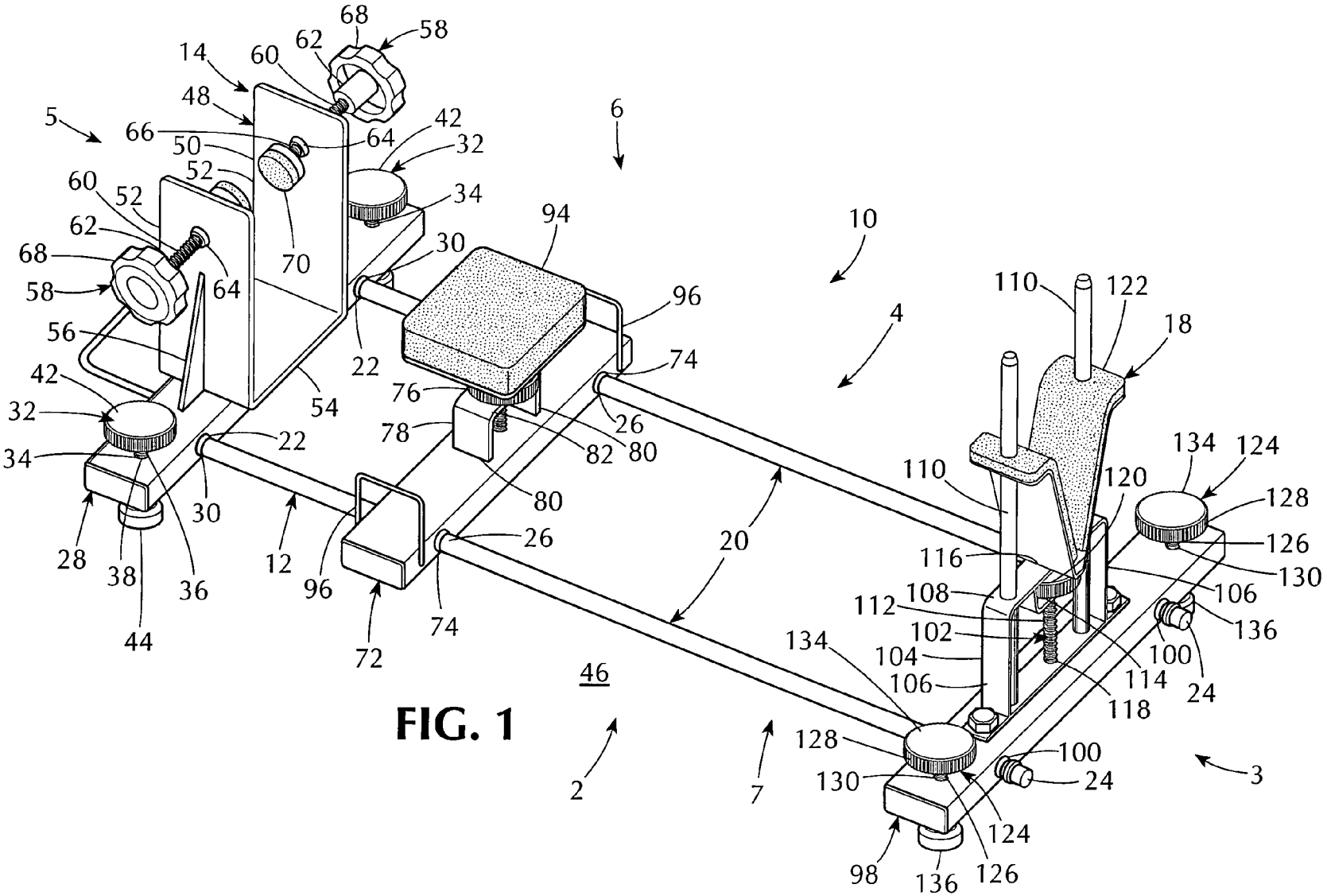
FIG. 1 is a diagrammatic perspective view of the rest of the embodiments of the present invention for cleaning a rifle and for sighting a scope, a stock, and a bore of the rifle.
Figure 2:
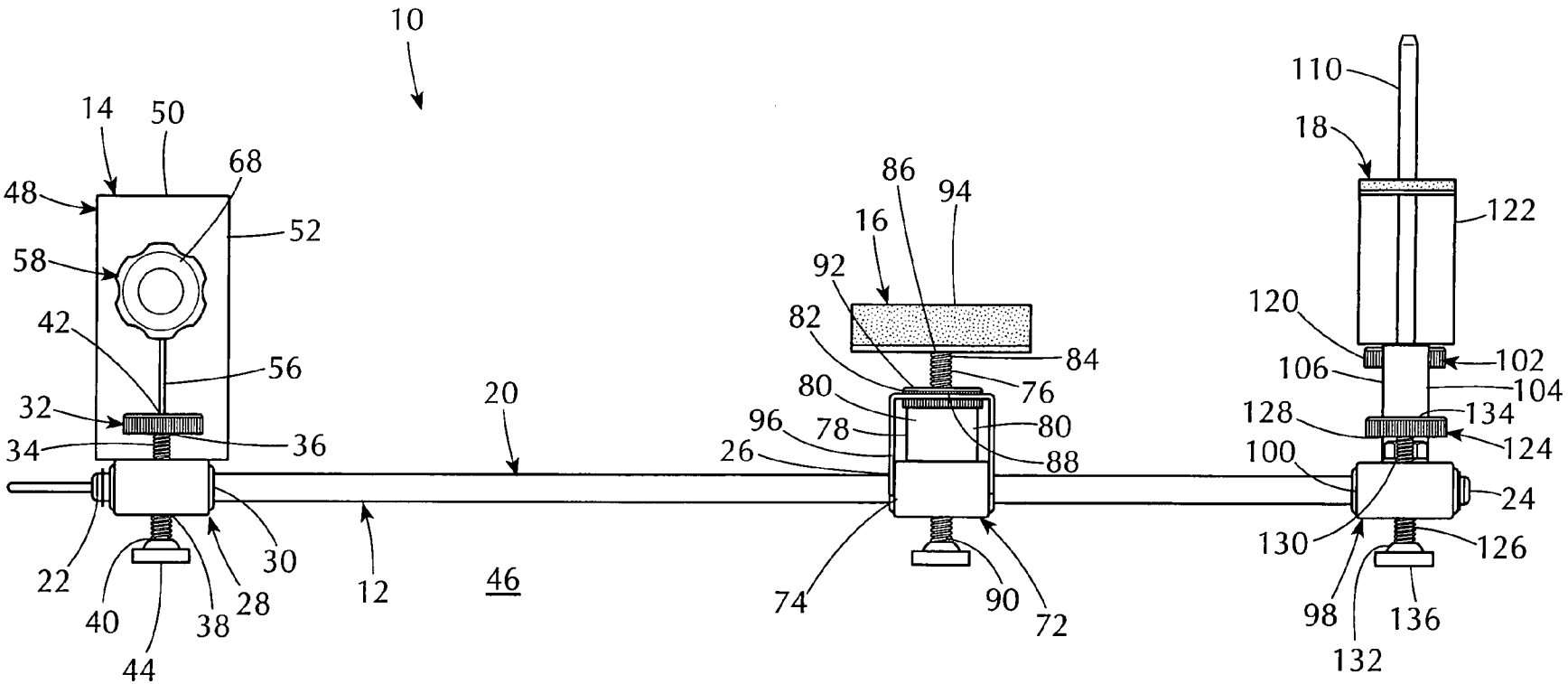
FIG. 2 is a diagrammatic right elevational view taken generally in the direction of ARROW 2 in FIG. 1.
Figure 3:
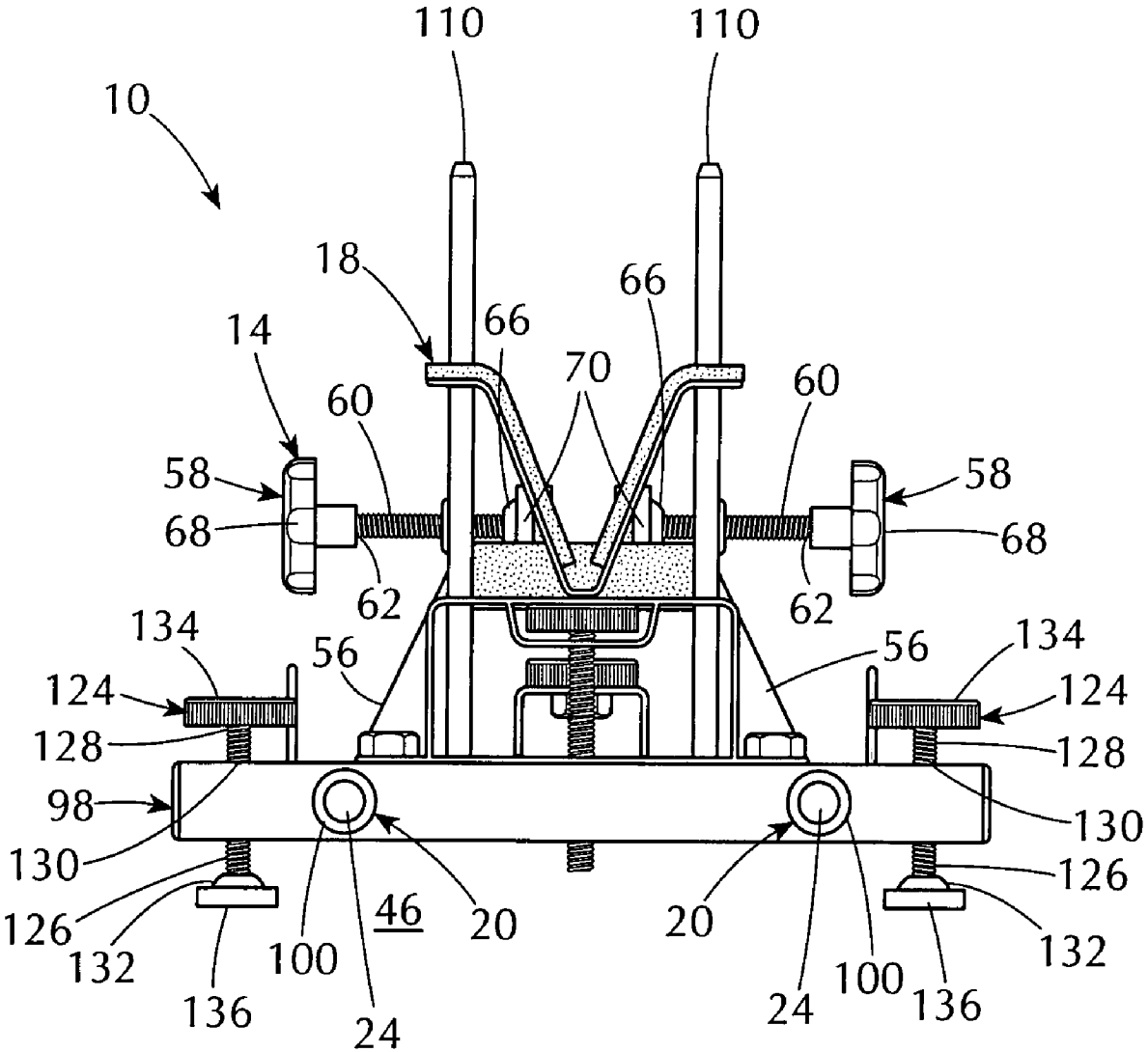
FIG. 3 is a diagrammatic front end view taken generally in the direction of ARROW 3 in FIG. 1.
Figure 4:
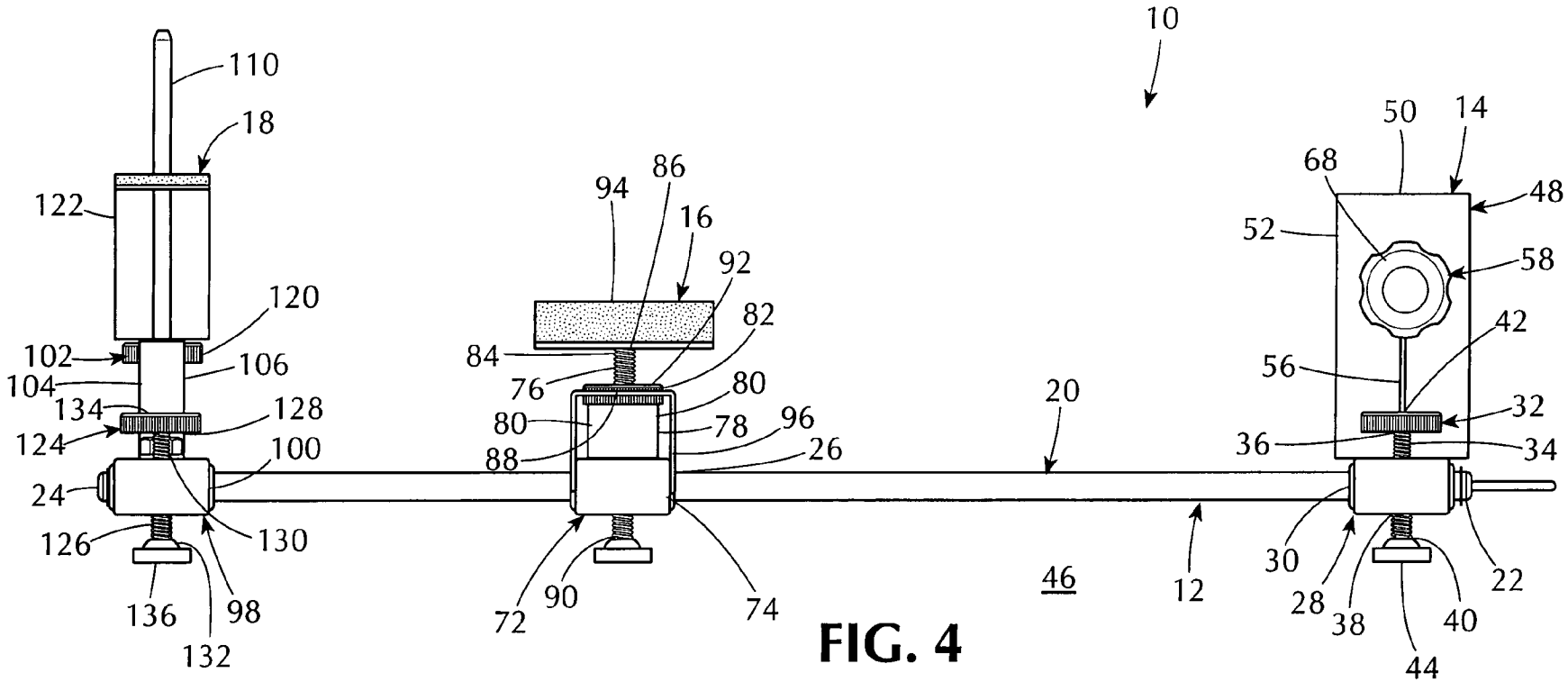
FIG. 4 is a diagrammatic left elevational view taken generally in the direction of ARROW 4 in FIG. 1.
Figure 5:
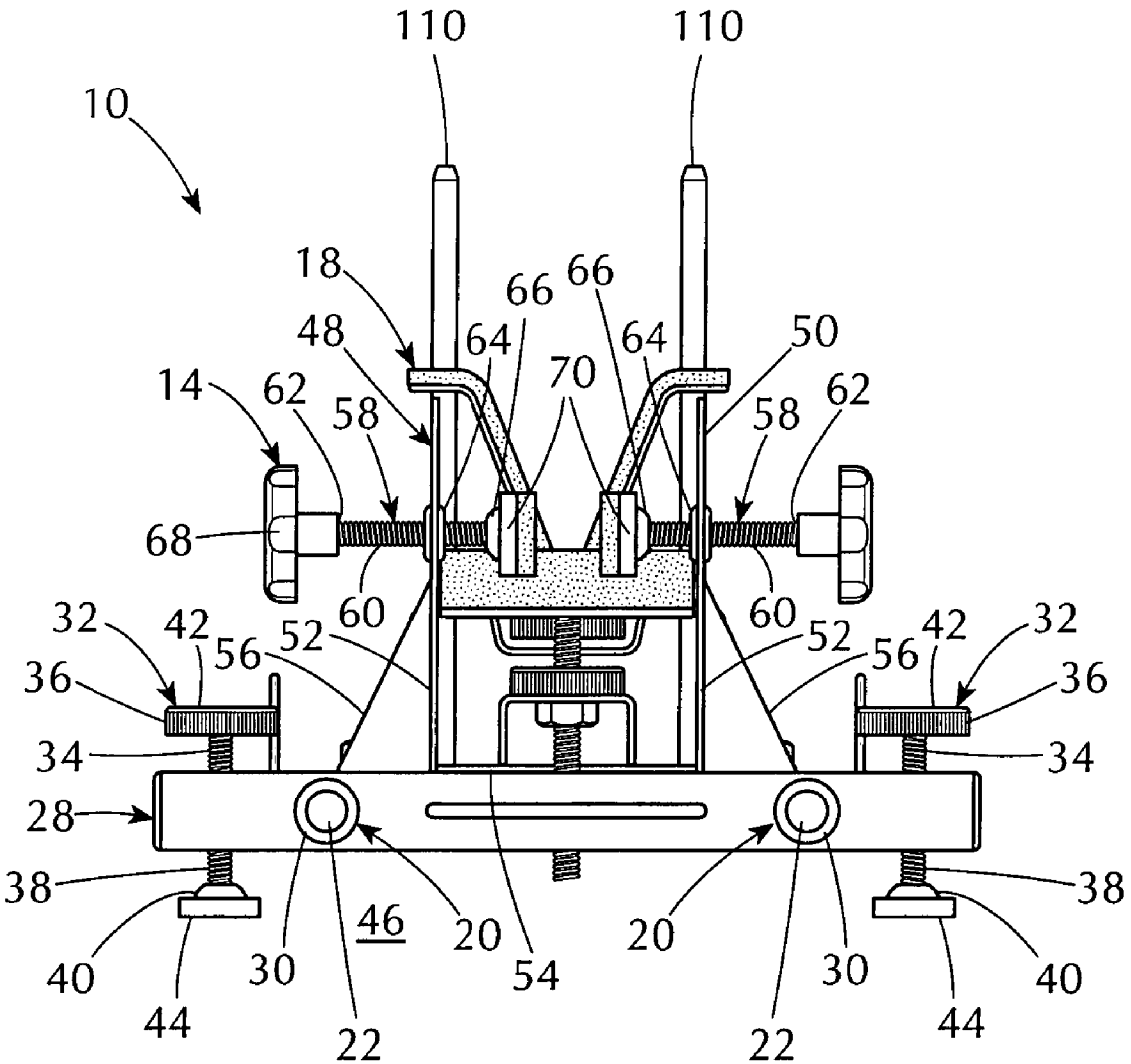
FIG. 5 is a diagrammatic back end view taken generally in the direction of ARROW 5 in FIG. 1.
Figure 6:
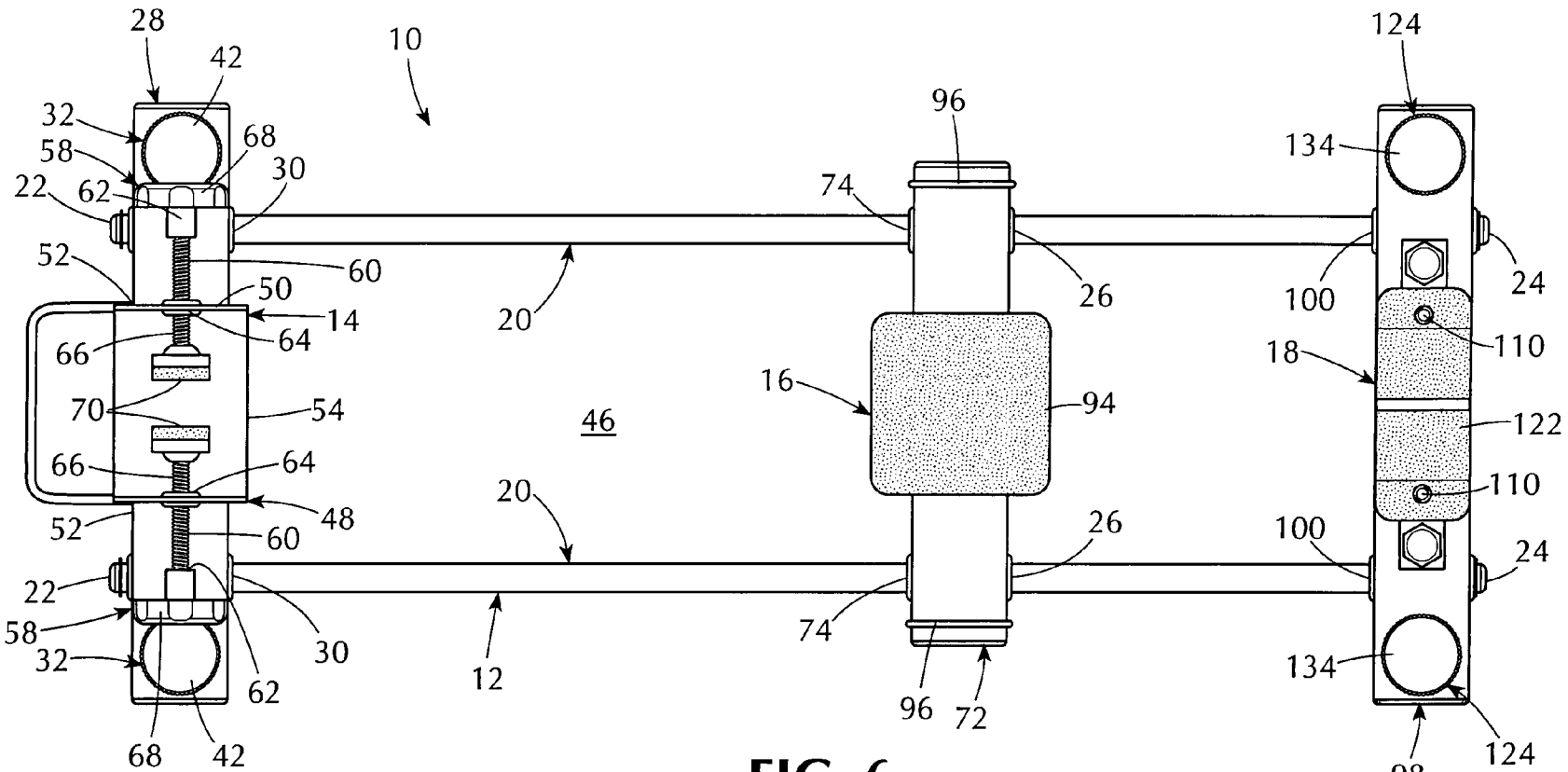
FIG. 6 is a diagrammatic top plan view taken generally in the direction of ARROW 6 in FIG. 1.
Figure 7:
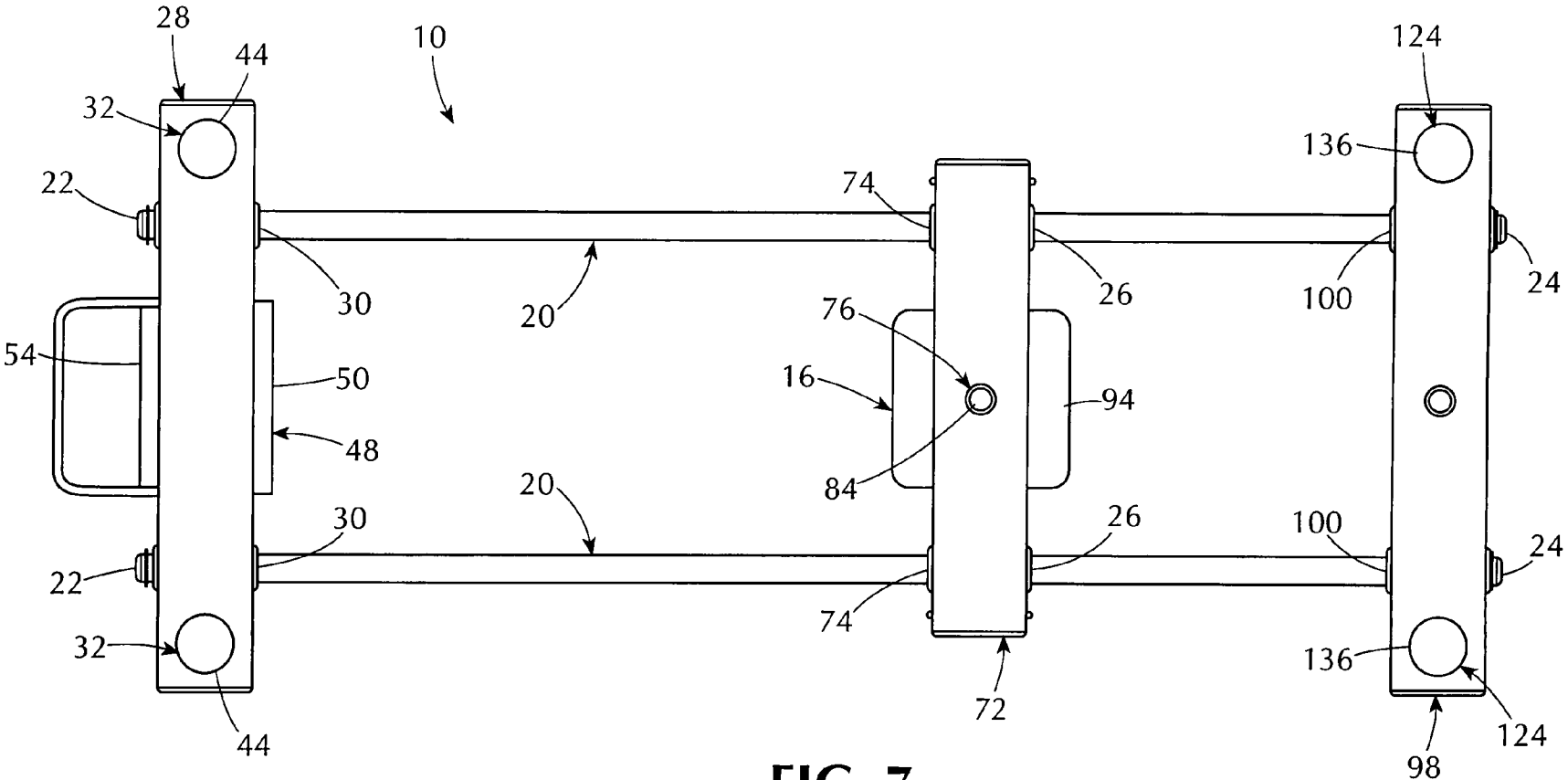
FIG. 7 is a diagrammatic bottom plan view taken generally in the direction of ARROW 7 in FIG. 1.

A. General.

10 rest of embodiments of present invention for cleaning rifle (not shown) and for sighting scope (not shown), stock (not shown), and bore (not shown) of rifle (not shown)

B. Overall Configuration of Rest 10.

12 base

14 vise assembly for adjusting for different-length rifles and for clamping stock (not shown) of rifle (not shown) therein

16 fore-end support assembly for adjusting for different-length rifles and for vertically adjustably supporting fore-end (not shown) of rifle (not shown) thereon

18 elevator assembly for adjusting for different-length rifles and for vertically adjustably supporting barrel (not shown) of rifle (not shown) therein C. Specific Configuration of Base 12.

20 pair of rods of base 12

22 rear ends of pair of rods 20 of base 12, respectively

24 front ends of pair of rods 20 of base 12, respectively

26 intermediate points of pair of rods 20 of base 12, respectively

D. Specific Configuration of Vise Assembly 14.

28 base of vise assembly 14

30 pair of through bores through base 28 of vise assembly 14

32 pair of height adjusters of vise assembly 14

34 threaded rod of each height adjuster of pair of height adjusters 32 of vise assembly 14

36 upper end of threaded rod 34 of each height adjuster of pair of height adjusters 32 of vise assembly 14

38 threaded through bore through base 28 of vise assembly 14 of each height adjuster of pair of height adjusters 32 of vise assembly 14

40 lower end of threaded rod 34 of each height adjuster of pair of height adjusters 32 of vise assembly 14

42 knob of each height adjuster of pair of height adjusters of vise assembly 14

44 foot of each height adjuster of pair of height adjusters of vise assembly 14 for contacting unyielding surface 46 upon which rest 10 rests

46 unyielding surface upon which rest 10 rests

48 cradle of vise assembly 14 for holding stock (not shown) of rifle (not shown) therein

50 body of cradle 48 of vise assembly 14

52 pair of upright portions of body 50 of cradle 48 of vise assembly 14

54 transverse portion of body 50 of cradle 48 of vise assembly 14

56 pair of braces of cradle 48 of vise assembly 14

58 pair of clamp assemblies of vise assembly 14 for clamping stock (not shown) of rifle (not shown) in cradle 48 of vice assembly 14

60 threaded rod of each clamp assembly of pair of clamp assemblies 58 of vise assembly 14

62 outer end of threaded rod 60 of each clamp assembly of pair of clamp assemblies 58 of vise assembly 14

64 threaded through bore through each upright portion of pair of upright portions 52 of body 50 of cradle 48 of vise assembly 14

66 inner end of threaded rod 60 of each clamp assembly of pair of clamp assemblies 58 of vise assembly 14

68 knob of each clamp assembly of pair of clamp assemblies 58 of vise assembly 14

70 foot of each clamp assembly of pair of clamp assemblies 58 of vise assembly 14 for contacting stock (not shown) of rifle (not shown)

E. Specific Configuration of Fore-End Support Assembly 16.

72 base of fore-end support assembly 16

74 pair of through bores through base 72 of fore-end support assembly 16

76 height adjuster of fore-end support assembly 16

78 stationary portion of height adjuster 76 of fore-end support assembly 16

80 pair of upright portions of stationary portion 78 of height adjuster 76 of fore-end support assembly 16

82 transverse portion of stationary portion 78 of height adjuster 76 of fore-end support assembly 16

84 threaded rod of height adjuster 76 of fore-end support assembly 16

86 upper end of threaded rod 84 of height adjuster 76 of fore-end support assembly 16

88 threaded through bore through transverse portion 82 of stationary portion 78 of height adjuster 76 of fore-end support assembly 16

90 lower end of threaded rod 84 of height adjuster 76 of fore-end support assembly 16

92 thumb wheel of height adjuster 76 of fore-end support assembly 16

94 cushioned block of height adjuster 76 of fore-end support assembly 16 for supporting fore-end (not shown) of rifle (not shown) thereon

96 pair of strap loops of base 72 of fore-end support assembly 16 for being engaged by hook and loop fastener strap (not shown) overlying rifle (not shown) thereby maintaining rifle (not shown ) against cushioned block 94 of height adjuster 76 of fore-end support assembly 16

F. Specific Configuration of Elevator Assembly 18.

98 base of elevator assembly 18

100 pair of through bores through base 98 of elevator assembly 18

102 primary height adjuster of elevator assembly 18

104 stationary portion of primary height adjuster 102 of elevator assembly 18
106 pair of upright portions of stationary portion 104 of primary height adjuster 102 of elevator assembly 18
108 transverse portion of stationary portion 104 of primary height adjuster 102 of elevator assembly 18
110 pair of guide rods of stationary portion 104 of primary height adjuster 102 of elevator assembly 18
112 threaded rod of primary height adjuster 102 of elevator assembly 18
114 upper end of threaded rod 112 of primary height adjuster 102 of elevator assembly 18
116 threaded through bore through transverse portion 108 of stationary portion 104 of primary height adjuster 102 of elevator assembly 18
118 lower end of threaded rod 112 of primary height adjuster 102 of elevator assembly 18
120 thumb wheel of primary height adjuster 102 of elevator assembly 18
122 cushioned V block of primary height adjuster 102 of elevator assembly 18 for supporting barrel (not shown) of rifle (not shown) therein
124 pair of secondary height adjusters of elevator assembly 18
126 threaded rod of each secondary height adjuster of pair of secondary adjusters 124 of elevator assembly 18
128 upper end of threaded rod of each secondary height adjuster of pair of secondary adjusters 124 of elevator assembly 18
130 threaded through bore through base 98 of elevator assembly 18
132 lower end of threaded rod 126 of each secondary height adjuster of pair of secondary adjusters 124 of elevator assembly 18
134 knob of each secondary height adjuster of pair of secondary adjusters 124 of elevator assembly 18
136 foot of each secondary height adjuster of pair of secondary adjusters 124 of elevator assembly 18 for contacting unyielding surface 46 upon which rest 10 rests G. Specific Configuration of Lapping Tool 138.
138 lapping tool
140 cylinder of lapping tool 138 for extending back and forth through mounting rings 144 for scope (not shown) for insuring smoothness and proper interior profile 146 of mounting rings 144 for scope (not shown) so as to prevent stressing in scope (not shown)
142 abrasive compound of lapping tool 138
144 mounting rings for scope (not shown)
146 interior profile of mounting rings 144 for scope (not shown)
148 handle of lapping tool 138 for assisting in extending back and forth of cylinder 144 of lapping tool 138 through mounting rings 144 for scope (not shown)
150 end of cylinder 140 of lapping tool 138
152 side of cylinder 140 of lapping tool 138
154 shaft of handle 148 of lapping tool 138
156 ball of handle 148 of lapping tool 138

H. Specific Configuration of Alignment Tools 158.
158 alignment tools for aligning long axis 160 of mounting rings 144 for scope (not shown) for insuring that scope (not shown) fits properly without any binding or protrusions that could hinder operation of the scope (not shown)
160 long axis of mounting rings 144 for scope (not shown)
162 pair of cylinders of alignment tools 158
164 points of pair of cylinders 162 of alignment tools 158

I. Specific Configuration of Stock Alignment Tool 166.
166 stock alignment tool for lining up stock 168 of gun 170 so gun 170 can be leveled
168 stock of gun 170
170 gun
172 base of stock alignment tool 166
174 frame of stock alignment tool 166
176 clear plate of stock alignment tool 166
178 vertical alignment lines of clear plate 176 of stock alignment tool 166
180 level of stock alignment tool 166
182 vertical grooves of frame 174 of stock alignment tool 166
184 vise tightening device of stock alignment tool 166 for engaging against stock 168 of gun 170
186 leveling jacks of stock alignment tool 166
188 foam pad of stock alignment tool 166 for protecting stock 168 of gun 170

J. Specific Configuration of Bore Sighting Tool 190.
190 bore sighting tool for sighting bore 192 of gun 170 and for calibrating scope (not shown) of gun 170
192 bore of gun 170
194 base of bore sighting tool 190
196 frame of bore sighting tool 190
198 specifically calibrated target of bore sighting tool 190
200 level of bore sighting tool 190
202 perpendicular axes of specifically calibrated target 198 of bore sighting tool 190
204 vertical grooves of frame 196 of bore sighting tool 190
206 set of mandrels of bore sighting tool 190 for fitting into bores 192 of various caliber guns 170
208 pair of locking knobs of bore sighting tool 190
209 long axis of bore 192 of gun 170
210 leveling jacks of bore sighting tool 190
212 target height adjustor of bore sighting tool 190

K. Specific Configuration of Centering Tool 214.
214 centering tool for cradling, centering, and supporting gun 170
216 foam padded support of centering tool 214
218 V-shaped notch in foam padded support 216 of centering tool 214 for cradling, centering, and supporting gun 170
220 leveling jacks of centering tool 214
222 base of centering tool 214
224 bushings of centering tool 214
226 through bores through base 222 of centering tool 214
228 snap rings of centering tool 214

L. Specific Configuration of Set of Diopters 230.
230 set of diopters for attaching to objective end 234 of scope 232 to increase depth of field when target (not shown) is so close that scope 232 does not focus clearly
232 scope
234 objective end of scope 232
236 disk of each diopter of set of diopters 230
238 flange of each diopter of set of diopters 230 for engaging objective end 234 of scope 232
240 central through bore of disk 236 of each diopter of set of diopters 230 for increasing depth of field when target (not shown) is so close that scope 232 does not focus clearly

5. DETAILED DESCRIPTION OF THE PREFERRED EMBODIMENTS

A. General.

Referring now to the figures, in which like numerals indicate like parts, and particularly to FIGS. 1-7, which are, respectively, a diagrammatic perspective view of the rest of the embodiments of the present invention for cleaning a rifle (not shown) and for sighting a scope (not shown), a stock (not shown), and a bore (not shown) of the rifle (not shown), a diagrammatic right elevational view taken generally in the direction of ARROW 2 in FIG. 1, a diagrammatic front end view taken generally in the direction of ARROW 3 in FIG. 1, a diagrammatic left elevational view taken generally in the direction of ARROW 4 in FIG. 1, a diagrammatic back end view taken generally in the direction of ARROW 5 in FIG. 1, a diagrammatic top plan view taken generally in the direction of ARROW 6 in FIG. 1, and a diagrammatic bottom plan view taken generally in the direction of ARROW 7 in FIG. 1, the rest of the embodiments of the present invention is shown generally at 10 for cleaning a rifle (not shown) and for sighting a scope (not shown), a stock (not shown), and a bore (not shown) of the rifle (not shown)

B. The Overall Configuration of the Rest 10.

The rest 10 comprises a base 12, a vise assembly 14, a fore-end support assembly 16, and an elevator assembly 18. The vise assembly 14 is movably mounted to the base 12 for adjusting for different-length rifles and is for clamping the stock (not shown) of the rifle (not shown) therein. The fore-end support assembly 16 is movably mounted to the base 12 for adjusting for the different-length rifles, forward of the vise assembly 14, and is for vertically adjustably supporting the fore-end (not shown) of the rifle (not shown) thereon. The elevator assembly 18 is movably mounted to the base 12 for adjusting for the different-length rifles, forward of the fore-end support assembly 16, and is for vertically adjustably supporting the barrel (not shown) of the rifle (not shown) therein.

C. The Specific Configuration of the Base 12.

The base 12 comprises a pair of rods 20. The pair of rods 20 of the base 12 are parallel to each other, spaced-apart from each other, and have rear ends 22, respectively, front ends 24, respectively, and intermediate points 26, respectively, that are intermediate the rear ends 22 thereof and the front ends 24 thereof.

The vise assembly 14 is disposed proximate to the rear ends 22 of the pair of rods 20 of the base 12, and is movable therealong for adjusting for the different-length rifles. The fore-end support assembly 16 is disposed proximate to the intermediate points 26 of the pair of rods 20 of the base 12, and is movable therealong for adjusting for the different-length rifles. The elevator assembly 18 is disposed proximate the front ends 24 of the pair of rods 20 of the base 12, and is movable therealong for adjusting for the different-length rifles.

D. The Specific Configuration of the Vise Assembly 14.

The vise assembly 14 comprises a base 28. The base 28 of the vise assembly 14 is generally rectangular-parallelepiped-shaped.

The base 28 of the vise assembly 14 has a pair of through bores 30 extending horizontally therethrough. The pair of through bores 30 through the base 28 of the vise assembly 14 movably receive the rear ends 22 of the pair of rods 20 of the base 12, respectively, and are movable therealong for adjusting for the different-length rifles.

The vise assembly 14 further comprises a pair of height adjusters 32. The pair of height adjusters 32 of the vise assembly 14 extend vertically adjustably through the base 28 of the vise assembly 14, outboard of the pair of through bores 30 through the base 28 of the vise assembly 14, respectively.

Each height adjuster 32 of the vise assembly 14 comprises a threaded rod 34. The threaded rod 34 of each height adjuster 32 of the vise assembly 14 threads vertically, at an upper end 36 of the threaded rod 34 of an associated height adjuster 32 of the vise assembly 14, through a threaded through bore 38 through the base 28 of the vise assembly 14, to a lower end 40 of the threaded rod 34 of the associated height adjuster 32 of the vise assembly 14.

Each height adjuster 32 of the vise assembly 14 further comprises a knob 42. The knob 42 of each height adjuster 32 of the vise assembly 14 is disposed on the upper end 36 of the threaded rod 34 of an associated height adjuster 32 of the vise assembly 14, and rotates therewith.

Each height adjuster 32 of the vise assembly 14 further comprises a foot 44. The foot 44 of each height adjuster 32 of the vise assembly 14 is disposed on the lower end 40 of the threaded rod 34 of an associated height adjuster 32 of the vise assembly 14, rotates therewith, and is for contacting an unyielding surface 46 upon which the rest 10 rests.

The vise assembly 14 further comprises a cradle 48. The cradle 48 of the vise assembly 14 is for holding the stock (not shown) of the rifle (not shown) therein, and has a body 50. The body 50 of the cradle 48 of the vise assembly 14 is generally U-shaped so as to have a pair of upright portions 52 and a transverse portion 54. The transverse portion 54 of the body 50 of the cradle 48 of the vise assembly 14 extends along and is affixed generally centrally to the base 28 of the vise assembly 15, with the pair of upright portions 52 of the body 50 of the cradle 48 of the vise assembly 14 extending vertically upwardly therefrom.

The cradle 48 of the vise assembly 14 further has a pair of braces 56. The pair of braces 56 of the cradle 48 of the vise assembly 14 are generally triangular and extend from the pair of upright portions 52 of the body 50 of the cradle 48 of the vise assembly 14, respectively, to the base 28 of the vise assembly 14.

The vise assembly 14 further comprises a pair of clamp assemblies 58. The pair of clamp assemblies 58 of the vise assembly 14 are for clamping the stock (not shown) of the rifle (not shown) in the cradle 48 of the vice assembly 14, and extend horizontally adjustably through the pair of upright portions 52 of the body 50 of the cradle 48 of the vise assembly 14, respectively, above the pair of braces 56 of the cradle 48 of the vise assembly 14, respectively.

Each clamp assembly 58 of the vise assembly 14 comprises a threaded rod 60. The threaded rod 60 of each clamp assembly 58 of the vise assembly 14 threads horizontally, at an outer end 62 of the threaded rod 60 of an associated clamp assembly 58 of the vise assembly 14, through a threaded through bore 64 through an associated upright portion 52 of the body 50 of the cradle 48 of the vise assembly 14, to an inner end 66 of the threaded rod 60 of the associated clamp assembly 58 of the vise assembly 14.

Each clamp assembly 58 of the vise assembly 14 further comprises a knob 68. The knob 68 of each clamp assembly 58 of the vise assembly 14 is disposed on the outer end 62 of the threaded rod 60 of an associated clamp assembly 58 of the vise assembly 14, and rotates therewith.

Each clamp assembly 58 of the vise assembly 14 further comprises a foot 70. The foot 70 of each clamp assembly 58 of the vise assembly 14 is disposed on the inner end 66 of the threaded rod 60 of an associated clamp assembly 58 of the vise assembly 14, rotates therewith, and is cushioned for contacting the stock (not shown) of the rifle (not shown).

E. The Specific Configuration of the Fore-End Support Assembly 16.

The fore-end support assembly 16 comprises a base 72. The base 72 of the fore-end support assembly 16 is generally rectangular-parallelepiped-shaped.

The base 72 of the fore-end support assembly 16 has a pair of through bores 74 extending horizontally therethrough. The pair of through bores 74 through the base 72 of the fore-end support assembly 16 align with the pair of through bores 30 through the base 28 of the vise assembly 14, respectively, movably receive the intermediate points 26 of the pair of rods 20 of the base 12, respectively, and are movable therealong for adjusting for the different-length rifles.

The fore-end support assembly 16 further comprises a height adjuster 76. The height adjuster 76 of the fore-end support assembly 16 extends vertically adjustably from the base 72 of the fore-end support assembly 16, generally centrally thereat.

The height adjuster 76 of the fore-end support assembly 16 comprises a stationary portion 78. The stationary portion 78 of the height adjuster 76 of the fore-end support assembly 16 is generally inverted U-shaped so as to have a pair of upright portions 80 and a transverse portion 82. The pair of upright portions 80 of the stationary portion 78 of the height adjuster 76 of the fore-end support assembly 16 are affixed generally centrally to the base 72 of the fore-end support assembly 16, and extend vertically upwardly therefrom, with the transverse portion of the stationary portion 78 of the height adjuster 76 of the fore-end support assembly 16 extending horizontally thereacross.

The height adjuster 76 of the fore-end support assembly 16 further comprises a threaded rod 84. The threaded rod 84 of the height adjuster 76 of the fore-end support assembly 16 threads vertically, at an upper end 86 of the threaded rod 84 of the height adjuster 76 of the fore-end support assembly 16, through a threaded through bore 88 through the transverse portion of the stationary portion 78 of the height adjuster 76 of the fore-end support assembly 16, to a lower end 90 of the threaded rod 84 of the height adjuster 76 of the fore-end support assembly 16.

The height adjuster 76 of the fore-end support assembly 16 further comprises a thumb wheel 92. The thumb wheel 92 of the height adjuster 76 of the fore-end support assembly 16 is disposed along the threaded rod 84 of the height adjuster 76 of the fore-end support assembly 16, and rotates relative thereto.

The height adjuster 76 of the fore-end support assembly 16 further comprises a cushioned block 94. The cushioned block 94 of the height adjuster 76 of the fore-end support assembly 16 is disposed on the upper end 86 of the threaded rod 84 of the height adjuster 76 of the fore-end support assembly 16, rotates therewith, and is for supporting the fore-end (not shown) of the rifle (not shown) thereon.

The base 72 of the fore-end support assembly 16 further has a pair of strap loops 96. The pair of strap loops 96 of the base 72 of the fore-end support assembly 16 extend upwardly therefrom, outboard of the pair of rods 20 of the base 12, and are for being engaged by a hook and loop fastener strap (not shown) overlying the rifle (not shown) thereby maintaining the rifle (not shown ) against the cushioned block 94 of the height adjuster 76 of the fore-end support assembly 16.

F. The Specific Configuration of the Elevator Assembly 18.

The elevator assembly 18 comprises a base 98. The base 98 of the elevator assembly 18 is generally rectangular-parallelepiped-shaped.

The base 98 of the elevator assembly 18 has a pair of through bores 100 extending horizontally therethrough. The pair of through bores 100 through the base 98 of the elevator assembly 18 align with the pair of through bores 30 through the base 28 of the vise assembly 14, respectively, movably receive the front ends 24 of the pair of rods 20 of the base 12, respectively, and are movable therealong for adjusting for the different-length rifles.

The elevator assembly 18 further comprises a primary height adjuster 102. The primary height adjuster 102 of the elevator assembly 18 extends vertically adjustably from the base 98 of the elevator assembly 18, generally centrally thereat.

The primary height adjuster 102 of the elevator assembly 18 comprises a stationary portion 104. The stationary portion 104 of the primary height adjuster 102 of the elevator assembly 18 is generally inverted U-shaped so as to have a pair of upright portions 106 and a transverse portion 108. The pair of upright portions 106 of the stationary portion 104 of the primary height adjuster 102 of the elevator assembly 18 are affixed generally centrally to the base 98 of the elevator assembly 18, and extend vertically upwardly therefrom, with the transverse portion 108 of the stationary portion 104 of the primary height adjuster 102 of the elevator assembly 18 extending horizontally thereacross.

The stationary portion 104 of the primary height adjuster 102 of the elevator assembly 18 further has a pair of guide rods 110. The pair of guide rods 110 of the stationary portion 104 of the primary height adjuster 102 of the elevator assembly 18 extend vertically upwardly from the base 98 of the elevator assembly 18, through and past the transverse portion 108 of the stationary portion 104 of the primary height adjuster 102 of the elevator assembly 18, and just inboard of the pair of upright portions 106 of the stationary portion 104 of the primary height adjuster 102 of the elevator assembly 18, respectively.

The primary height adjuster 102 of the elevator assembly 18 further comprises a threaded rod 112. The threaded rod 112 of the primary height adjuster 102 of the elevator assembly 18 threads vertically, at an upper end 114 of the threaded rod 112 of the primary height adjuster 102 of the elevator assembly 18, through a threaded through bore 116 through the transverse portion 108 of the stationary portion 104 of the primary height adjuster 102 of the elevator assembly 18, to a lower end 118 of the threaded rod 112 of the primary height adjuster 102 of the elevator assembly 18.

The primary height adjuster 102 of the elevator assembly 18 further comprises a thumb wheel 120. The thumb wheel 120 of the primary height adjuster 102 of the elevator assembly 18 is disposed along the threaded rod 112 of the primary height adjuster 102 of the elevator assembly 18, and rotates relative thereto.

The primary height adjuster 102 of the elevator assembly 18 further comprises a cushioned V block 122. The cushioned V block 122 of the primary height adjuster 102 of the elevator assembly 18 is disposed on the upper end 114 of the threaded rod 112 of the primary height adjuster 102 of the elevator assembly 18, rotates therewith, runs vertically along the pair of guide rods 110 of the stationary portion 104 of the primary height adjuster 102 of the elevator assembly 18, and is for supporting the barrel (not shown) of the rifle (not shown) therein.

The elevator assembly 18 further comprises a pair of secondary height adjusters 124. The pair of secondary height adjusters 124 of the elevator assembly 18 extend vertically adjustably through the base 98 of the elevator assembly 18, outboard of the pair of through bores 100 through the base 98 of the elevator assembly 18, respectively.

Each secondary height adjuster 124 of the elevator assembly 18 comprises a threaded rod 126. The threaded rod 126 of each secondary height adjuster 124 of the elevator assembly 18 threads vertically, at an upper end 128 of the threaded rod 126 of an associated secondary height adjuster 124 of the elevator assembly 18, through a threaded through bore 130 through the base 98 of the elevator assembly 18, to a lower end 132 of the threaded rod 126 of the associated secondary height adjuster 124 of the elevator assembly 18.

Each secondary height adjuster 124 of the elevator assembly 18 further comprises a knob 134. The knob 134 of each secondary height adjuster 124 of the elevator assembly 18 is disposed on the upper end 128 of the threaded rod 126 of an associated secondary height adjuster 124 of the elevator assembly 18, and rotates therewith.

Each secondary height adjuster 124 of the elevator assembly 18 further comprises a foot 136. The foot 136 of each secondary height adjuster 124 of the elevator assembly 18 is disposed on the lower end 132 of the threaded rod 126 of an associated secondary height adjuster 124 of the elevator assembly 18, rotates therewith, and is for contacting the unyielding surface 46 upon which the rest 10 rests.

G. The Specific Configuration of the Lapping Tool 138.

Figure 8:
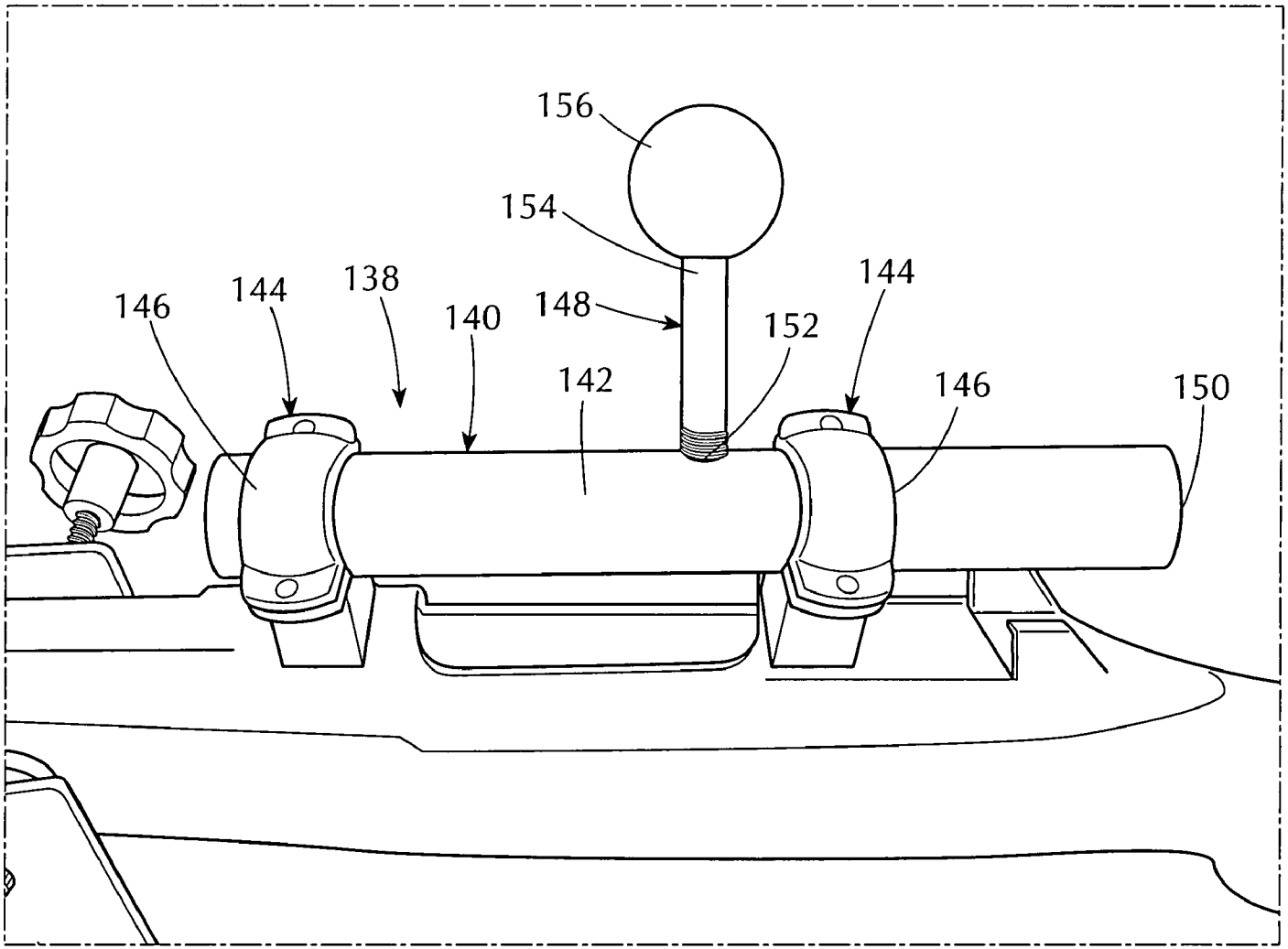
FIG. 8 is a diagrammatic perspective view of the lapping tool of the rest of the embodiments of the present invention.

The configuration of the lapping tool 138 can best be seen in FIG. 8, which is a diagrammatic perspective view of the lapping tool of the rest of the embodiments of the present invention, and as such, will be discussed with reference thereto.

The lapping tool 138 comprises a cylinder 140. The cylinder 140 of the lapping tool 138 is coated with an abrasive compound 142 for extending back and forth through the mounting rings 144 for the scope (not shown) for insuring smoothness and proper interior profile 146 of the mounting rings 144 for the scope (not shown) so as to prevent stressing in the scope (not shown).

The lapping tool 138 further comprises a handle 148. The handle 148 of the lapping tool 138 is attached to the cylinder 140 of the lapping tool 138, either axially at an end 150 of the cylinder 140 of the lapping tool 138 or radially at a side 152 of the cylinder 140 of the lapping tool 138, and is for assisting in the extending back and forth of the cylinder 140 of the lapping tool 138 through the mounting rings 144 for the scope (not shown).

The handle 148 of the lapping tool 138 comprises a shaft 154 and a ball 156. The shaft 154 of the handle 148 of the lapping tool 138 extends outwardly from the cylinder 140 of the lapping tool 138, either axially at the end 150 of the cylinder 140 of the lapping tool 138 or radially at the side 152 of the cylinder 140 of the lapping tool 138, and terminates in the ball 156 of the handle 148 of the lapping tool 138.

H. The Specific Configuration of the Alignment Tools 158.

Figure 9:
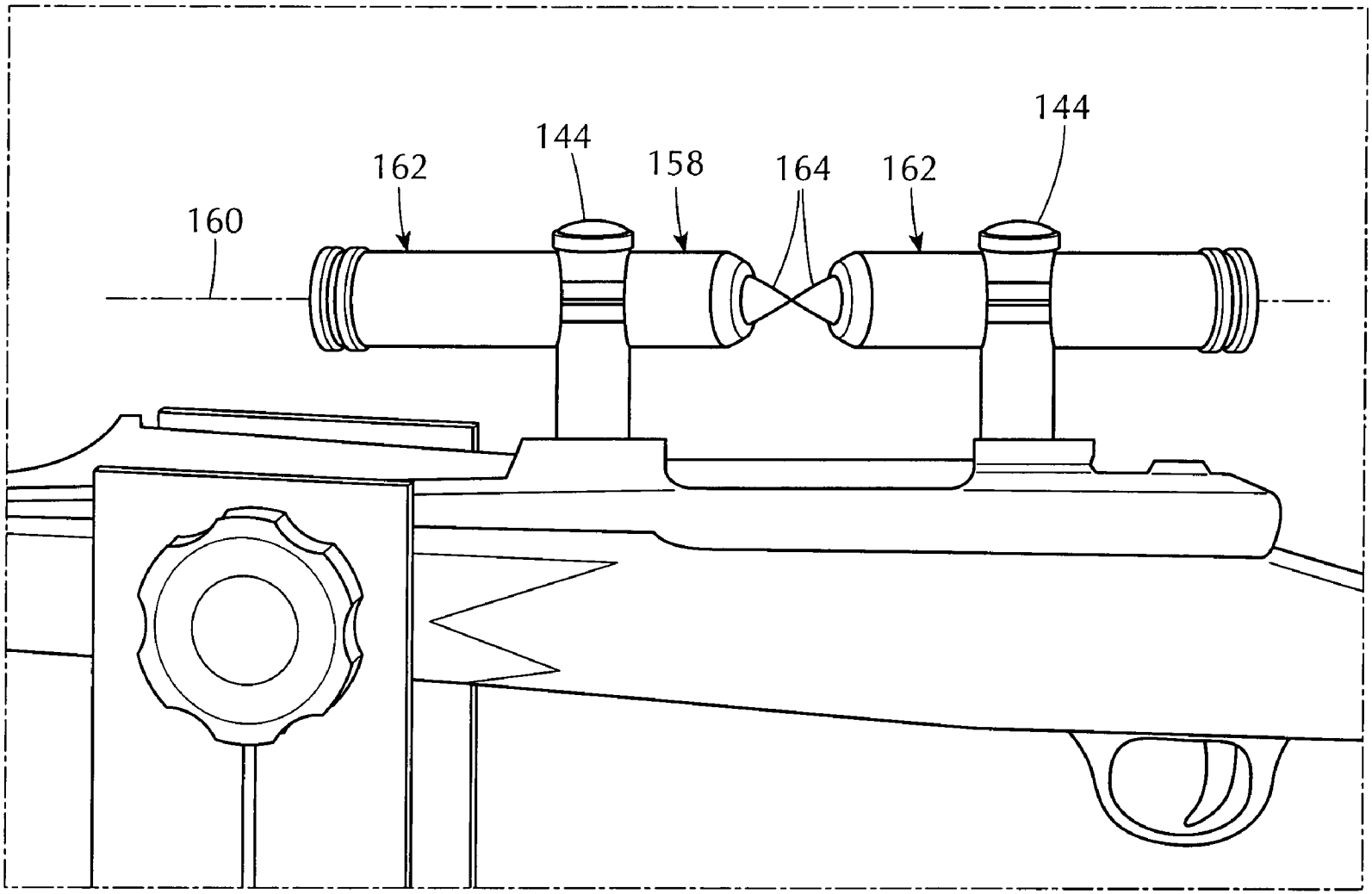
FIG. 9 is a diagrammatic perspective view of the alignment tools of the rest of the embodiments of the present invention.

The configuration of the alignment tools 158 can best be seen in FIG. 9, which is a diagrammatic perspective view of the alignment tools of the rest of the embodiments of the present invention, and as such, will be discussed with reference thereto.

The alignment tools 158 are for aligning a long axis 160 of the mounting rings 144 for the scope (not shown) for insuring that the scope (not shown) fits properly without any binding or protrusions that could hinder operation of the scope (not shown).

The alignment tool 158 comprises a pair of cylinders 162 terminating in points 164, respectively. The pair of cylinders 162 of the alignment tool 158 are for extending through the mounting rings 144 for the scope (not shown), with the points 164 of the pair of cylinders 162 of the alignment tool 158 facing each other, and with the mounting rings 144 for the scope (not shown) adjusted until the points 164 of the pair of cylinders 162 of the alignment tool 158 are aligned with each other.

I. The Specific Configuration of the Stock Alignment Tool 166.

Figure 10:
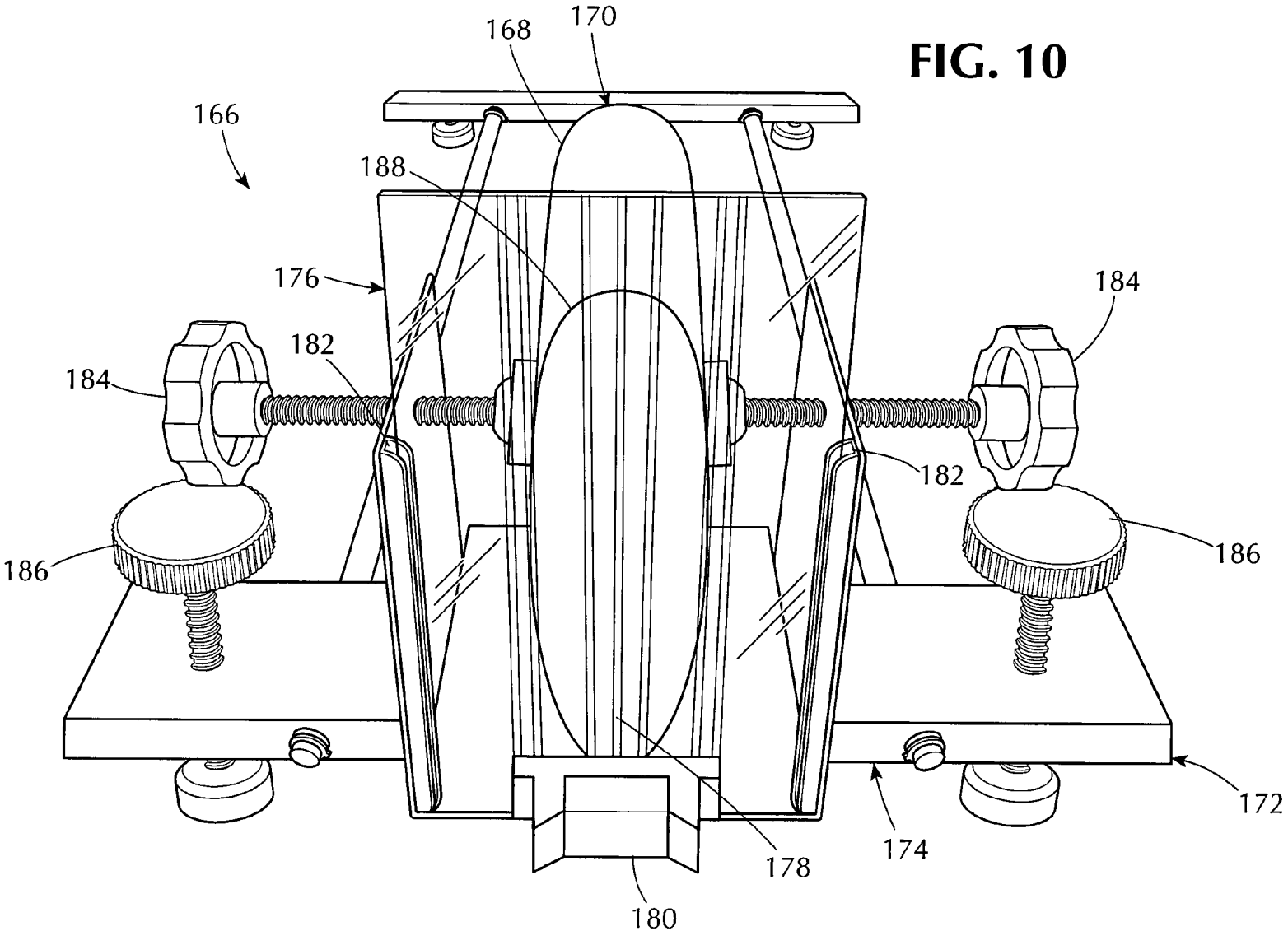
FIG. 10 is a diagrammatic rear end view of the stock alignment tool of the rest of the embodiments of the present invention.

The configuration of the stock alignment tool 166 can best be seen in FIG. 10, which is a diagrammatic rear end view of the stock alignment tool of the rest of the embodiments of the present invention, and as such, will be discussed with reference thereto.

The stock alignment tool 166 is for lining up a stock 168 of a gun 170 so the gun 170 can be leveled. A telescopic sight (not shown) is rotated so as to allow the cross hairs (not shown) of the telescopic sight (not shown), which are perpendicular, to align perfectly with the perpendicular axis (not shown) of the target (not shown), which makes the telescopic sight (not shown) level to the gun 170, when a target (not shown) also having perpendicular axes (not shown) is leveled and the gun 170 is then leveled The stock alignment tool 166 comprises a base 172, a frame 174, and a clear plate 176. The frame 174 of the stock alignment tool 166 extends upwardly from the base 172 of the stock alignment tool 166. The clear plate 176 of the stock alignment tool 166 is slidably mounted to the frame 174 of the stock alignment tool 166.

The clear plate 176 of the stock alignment tool 166 has vertical alignment lines 178 thereon.

The stock alignment tool 166 further comprises a level 180. The level 180 of the stock alignment tool 166 extends perpendicularly to the vertical alignment lines 178 of the clear plate 176 of the stock alignment tool 166.

The frame 174 of the stock alignment tool 166 has vertical grooves 182. The vertical grooves 182 of the frame 174 of the stock alignment tool 166 slidably receive the clear plate 176 of the stock alignment tool 166.

The stock alignment tool 166 further comprises a vise tightening device 184. The vise tightening device 184 of the stock alignment tool 166 extends adjustably and horizontally through the frame 174 of the stock alignment tool 166 for engaging against the stock 168 of the gun 170.

The stock alignment tool 166 further comprises leveling jacks 186. The leveling jacks 186 of the stock alignment tool 166 extend adjustably and vertically through the base 172 of the stock alignment tool 166, and level the clear plate 176 of the stock alignment tool 166.

The stock alignment tool 166 further comprises a foam pad 188. The foam pad 188 of the stock alignment tool 166 extends forwardly from the clear plate 176 of the stock alignment tool 166, and is for protecting the stock 168 of the gun 170.

J. The Specific Configuration of the Bore Sighting Tool 190.

Figure 11:
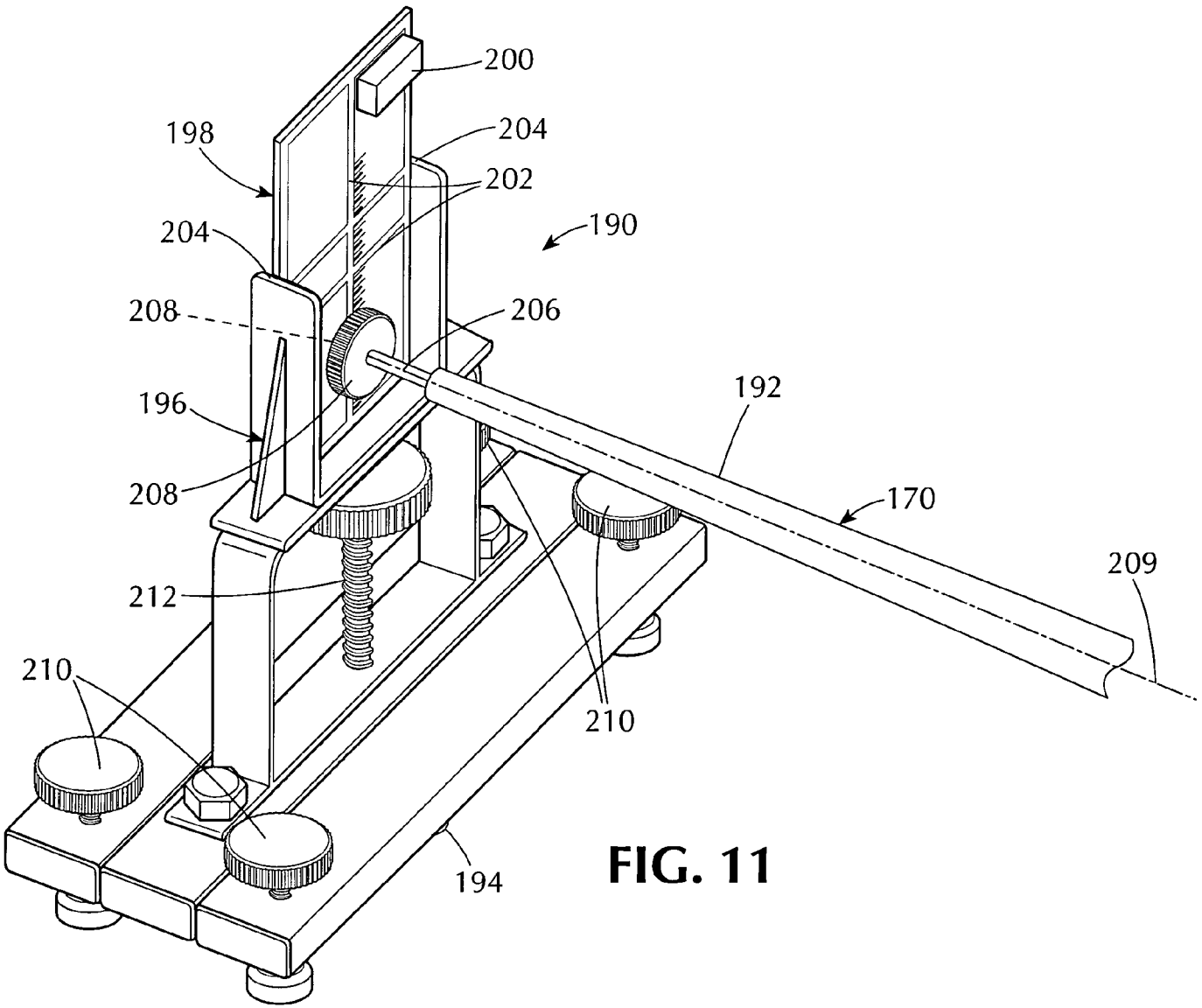
FIG. 11 is a diagrammatic perspective view of the bore sighting tool of the rest of the embodiments of the present invention.

The configuration of the bore sighting tool 190 can best be seen in FIG. 11, which is a diagrammatic perspective view of the bore sighting tool of the rest of the embodiments of the present invention, and as such, will be discussed with reference thereto.

The bore sighting tool 190 is for sighting the bore 192 of the gun 170 and for calibrating the scope (not shown) of the gun 170 to insure absolute, positive alignment, and leveling of all critical parts of the gun 170 so as to allow the gun 170 to be properly sighted without having to fire the gun 170, since it is not always easy to get to a range to calibrate the gun 170 and the scope (not shown).

The bore sighting tool 190 comprises a base 194, a frame 196, and a specifically calibrated target 198. The frame 196 of the bore sighting tool 190 extends adjustably and upwardly from the base 194 of the bore sighting tool 190. The specifically calibrated target 198 is slidably mounted to the frame 196 of the bore sighting tool 190.

The bore sighting tool 190 further comprises a level 200. The level 200 of the bore sighting tool 190 extends horizontally on, to level, the specifically calibrated target 198 of the bore sighting tool 190 so as to allow perpendicular axes 202 of the specifically calibrated target 198 of the bore sighting tool 190 to be vertical and horizontal.

The frame 196 of the bore sighting tool 190 has vertical grooves 204. The vertical grooves 204 of the frame 196 of the bore sighting tool 190 slidably receive the specifically calibrated target 198 of the bore sighting tool 190.

The bore sighting tool 190 further comprises a set of mandrels 206. The set of mandrels 206 of the bore sighting tool 190 include mandrels of varying sizes for fitting into the bores 192 of various caliber guns 170.

The set of mandrels 206 of the bore sighting tool 190 are made of plastic for preventing harm to the bores 192 of the various caliber guns 170.

The bore sighting tool 190 further comprises a pair of locking knobs 208. The pair of locking knobs 208 of the bore sighting tool 190 sandwich the specifically calibrated target 198 of the bore sighting tool 190 therebetween, and are operatively connected to a respective mandrel 206 of the bore sighting tool 190 to hold the respective mandrel 206 of the bore sighting tool 190 perpendicular to the specifically calibrated target 198 of the bore sighting tool 190.

The respective mandrel 206 of the bore sighting tool 190 is for inserting into the bore 192 of the gun 170, close to the specifically calibrated target 198 of the bore sighting tool 190 to assure that long axis 209 of the bore 192 of the gun 170 is perfectly horizontal to the specifically calibrated target 198 of the bore sighting tool 190 to perfectly align the scope (not shown) with appropriate markings of the perpendicular axes 202 of the specifically calibrated target 198 of the bore sighting tool 190 and thereby bore sight and calibrate the scope (not shown) precisely for elevation.

The bore sighting tool 190 further comprises leveling jacks 210. The leveling jacks 210 of the bore sighting tool 190 extend adjustably and vertically through the base 194 of the bore sighting tool 190, and level the specifically calibrated target 198 of the bore sighting tool 190.

The bore sighting tool 190 further comprises a target height adjustor 212. The target height adjustor 212 of the bore sighting tool 190 adjusts elevation of the frame 196 of the bore sighting tool 190 relative to the base 194 of the bore sighting tool 190.

K. The Specific Configuration of the Centering Tool 214.

Figure 12:
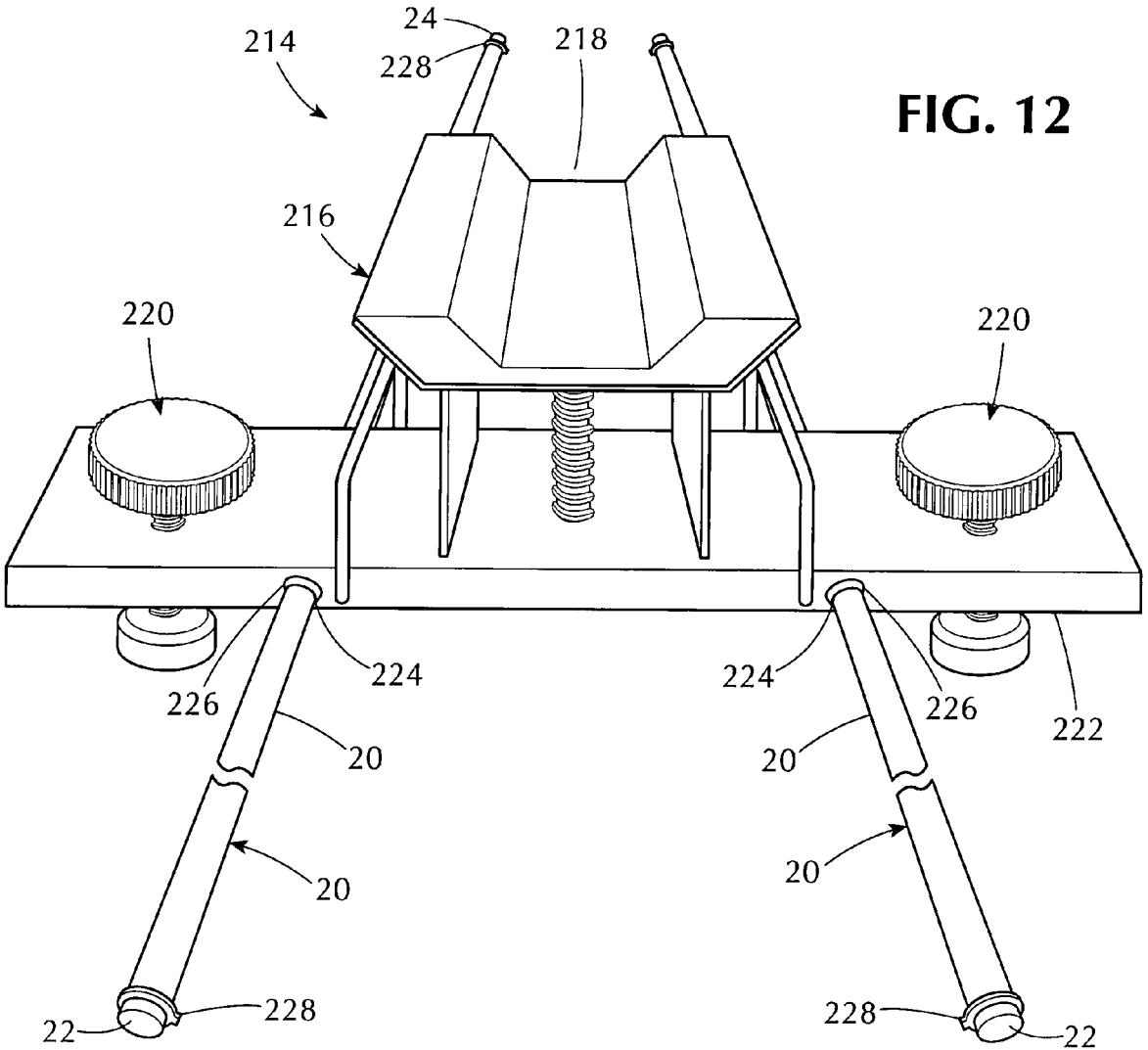
FIG. 12 is a diagrammatic perspective view of the centering tool of the rest of the embodiments of the present invention.

The configuration of the centering tool 214 can best be seen in FIG. 12, which is a diagrammatic perspective view of the centering tool of the rest of the embodiments of the present invention, and as such, will be discussed with reference thereto.

The centering tool 214 replaces the fore-end support assembly 16 and the elevator assembly 18, and is for cradling, centering, and supporting the gun 170.

The centering tool 214 is similar to the fore-end support assembly 16, except that:

The cushioned block 94 of the height adjuster 76 of the fore-end support assembly 16 is replaced by a foam padded support 216 having a V-shaped notch 218 for cradling, centering, and supporting the gun 170.

The centering tool 214 further comprises leveling jacks 220. The leveling jacks 220 of the centering tool 214 extend adjustably and vertically through the base 222 of the centering tool 214, and level the foam padded support 216 of the centering tool 214.

The centering tool 214 further comprises bushings 224. The bushings 224 of the centering tool 214 extend in through bores 226 through the base 222 of the centering tool 214 increasing slidability of the base 222 of the centering tool 214 on the pair of rods 20.

The centering tool 214 further comprises snap rings 228. The snap rings 228 of the centering tool 214 are disposed on the rear ends 22 of the pair of the rods 20 and on the front ends 24 of the pair of rods 20 to prevent the centering tool 214 from exiting the pair of rods 20.

L. The Specific Configuration of the Set of Diopters 230.

Figure 13:
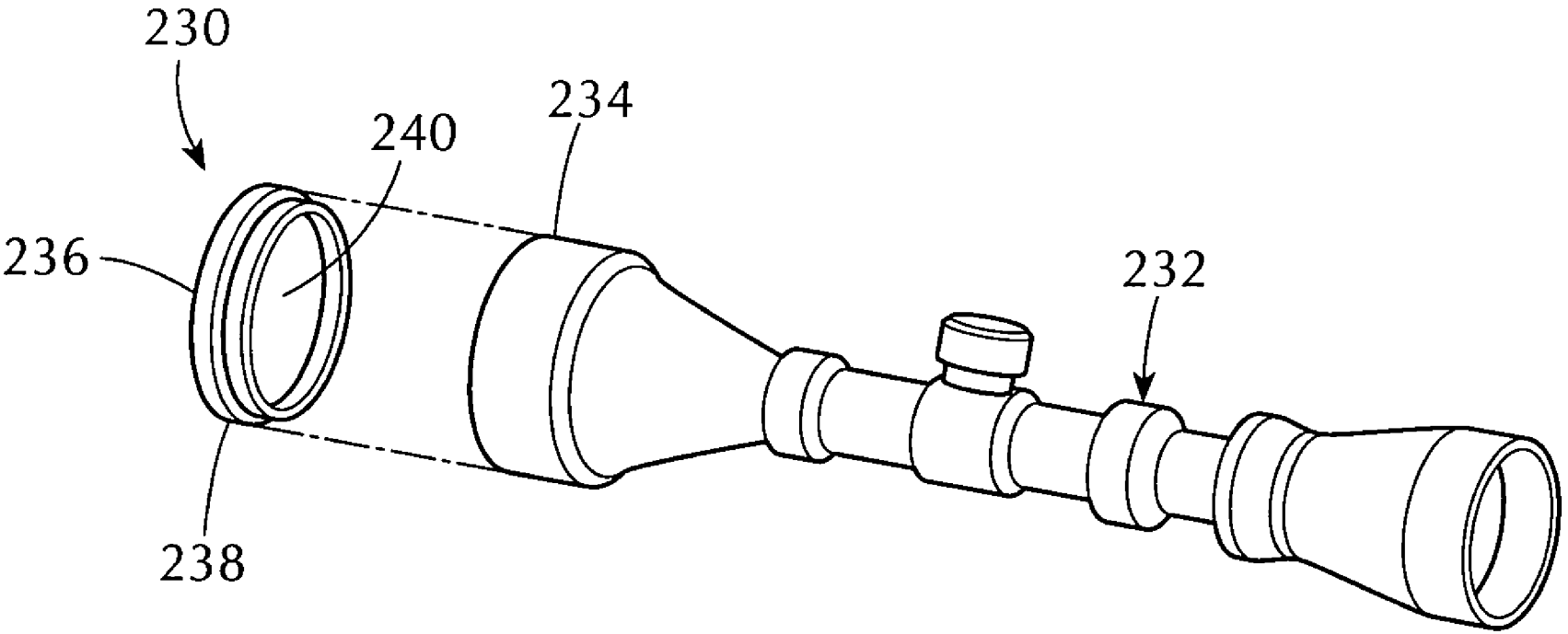
FIG. 13 is a diagrammatic perspective view of the set of diopters of the rest of the embodiments of the present invention.

The set of diopters 230 can best be seen in FIG. 13, which is a diagrammatic perspective view of the set of diopters of the rest of the embodiments of the present invention, and as such, will be discussed with reference thereto.

A respective diopter 230 is for attaching to an objective end 234 of a scope 232 to increase depth of field when a target (not shown) is so close that the scope 232 does not focus clearly.

The respective diopter of the set of diopters 230 comprises a disk 236 and a flange 238. The flange 238 of the respective diopter of the set of diopters 230 extends circumferentially around the disk 236 of the respective diopter of the set of diopters 230 and is for engaging the objective end 234 of the scope 232.

The disk 236 of the respective diopter of the set of diopters 230 has a central through bore 240 for increasing the depth of field when the target (not shown) is so close that the scope 232 does not focus clearly.

M. The Conclusions.

It will be understood that each of the elements described above or two or more together may also find a useful application in other types of constructions differing from the types described above.

While the embodiments of the present invention have been illustrated and described as embodied in a rest for cleaning a rifle and for sighting a scope, a stock, and a bore of the rifle, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A rest for cleaning a rifle and for sighting a scope, a stock, and a bore of the rifle, wherein the rifle has a stock, a fore-end, and a barrel, said rest comprising;

a) a base;

b) a vise assembly;

c) a fore-end support assembly; and d) an elevator assembly;

wherein said vise assembly is movably mounted to said base for adjusting for different-length rifles;

wherein said vise assembly is for clamping the stock of the rifle therein;

wherein said fore-end support assembly is movably mounted to said base for adjusting for the different-length rifles;

wherein said fore-end support assembly is forward of said vise assembly;

wherein said fore-end support assembly is for vertically adjustably supporting the fore-end of the rifle thereon;

wherein said elevator assembly is movably mounted to said base for adjusting for the different-length rifles;

wherein said elevator assembly is forward of said fore-end support assembly;

wherein said elevator assembly is for vertically adjustably supporting the barrel of the rifle therein;

wherein said vise assembly comprises a cradle;

wherein said cradle of said vise assembly is for holding the stock of the rifle therein;

wherein said cradle of said vise assembly has a body;

wherein said body of said cradle of said vise assembly is U-shaped so as to have a pair of upright portions and a transverse portion;

wherein said pair of upright portions of said body of said cradle of said vise assembly extend vertically upwardly from said transverse portion of said body of said cradle of said vise assembly;

wherein said vise assembly comprises a pair of clamp assemblies;

wherein said pair of clamp assemblies of said vise assembly extend horizontally adjustably through said pair of upright portions of said body of said cradle of said vise assembly, respectively wherein said vise assembly has a base;

wherein said transverse portion of said body of said cradle of said vise assembly extends along said base of said vise assembly;

wherein said transverse portion of said body of said cradle of said vise assembly is affixed to said base of said vise assembly;

wherein said cradle of said vise assembly has a pair of braces;

wherein said pair of braces of said cradle of said vise assembly extend from said pair of upright portions of said body of said cradle of said vise assembly, respectively, to said base of said vise assembly;

wherein said pair of clamp assemblies of said vise assembly are for clamping the stock of the rifle in said cradle of said vice assembly;

wherein said pair of clamp assemblies of said vise assembly are above said pair of braces of said cradle of said vise assembly, respectively;

wherein each clamp assembly of said vise assembly comprises a threaded rod; and wherein said threaded rod of each clamp assembly of said vise assembly threads horizontally, at an outer end of said threaded rod of an associated clamp assembly of said vise assembly, through a threaded through bore through an associated upright portion of said body of said cradle of said vise assembly, to an inner end of said threaded rod of said associated clamp assembly of said vise assembly.

2. The rest of claim 1, wherein each clamp assembly of said vise assembly comprises a knob;

wherein said knob of each clamp assembly of said vise assembly is disposed on said outer end of said threaded rod of an associated clamp assembly of said vise assembly; and wherein said knob of each clamp assembly of said vise assembly rotates with said outer end of said threaded rod of said associated clamp assembly of said vise assembly.

3. The rest of claim 1, wherein each clamp assembly of said vise assembly comprises a foot;

wherein said foot of each clamp assembly of said vise assembly is disposed on said inner end of said threaded rod of an associated clamp assembly of said vise assembly;

wherein said foot of each clamp assembly of said vise assembly rotates with said inner end of said threaded rod of said associated clamp assembly of said vise assembly; and wherein said foot of each clamp assembly of said vise assembly is for contacting the stock of the rifle.

* * * * *